United States Patent [19]

DiPippo

[11] 4,289,839

[45] Sep. 15, 1981

[54] NEGATIVE IMAGE DIAZOGRAPHY FORMULATION WITH ACID LABILE COUPLER, DIAZONIUM COMPOUND AND CARBOXYLIC ACID ANHYDRIDE

[75] Inventor: Carmine A. DiPippo, Longmeadow, Mass.

[73] Assignee: James River Graphics, Inc., South Hadley, Mass.

[21] Appl. No.: 121,883

[22] Filed: Feb. 15, 1980

Related U.S. Application Data

[63] Continuation-in-part of Ser. No. 75,833, Sep. 14, 1979, abandoned, which is a continuation of Ser. No. 902,961, May 4, 1978, abandoned, which is a continuation of Ser. No. 734,975, Oct. 22, 1976, abandoned.

[51] Int. Cl.[3] ..... G03C 1/54; G03C 1/58; G03C 1/60

[52] U.S. Cl. ..... 430/177; 430/147; 430/171; 430/179; 430/180; 430/181; 430/183; 430/163; 430/150; 430/151; 430/339; 430/344

[58] Field of Search ..... 430/147, 177, 180, 181, 430/146, 179, 339, 344

[56] References Cited

U.S. PATENT DOCUMENTS

| | | | |
|---|---|---|---|
| 2,381,984 | 8/1945 | Reichel | 96/91 R |
| 2,516,931 | 8/1950 | Von Glahn et al. | 96/91 R |
| 3,303,028 | 2/1967 | Aebi et al. | 96/91 R |
| 3,499,760 | 3/1970 | Amariti et al. | 96/91 R |
| 3,695,885 | 10/1972 | Maryama | 96/91 R |
| 3,708,296 | 1/1973 | Schlesinger | 96/91 R |
| 3,765,895 | 10/1973 | Fox | 96/75 |
| 3,769,018 | 10/1973 | Hectors | 96/91 R |
| 3,899,335 | 8/1975 | Przezdziecki | 96/91 R |
| 3,960,684 | 6/1976 | Feinberg | 96/91 R |
| 3,976,491 | 8/1976 | Desjerlais | 96/49 |

OTHER PUBLICATIONS

Kosar, J., *Photographic Science and Engineering*, vol. 5, No. 4, 8/1961, pp. 239–243.

Noller, C. R., "Textbook of Organic Chemistry", 2nd Ed., W. B. Saunders Co., 1951, p. 104.

*Primary Examiner*—Charles L. Bowers, Jr.

*Attorney, Agent, or Firm*—Burns, Doane, Swecker & Mathis

[57] ABSTRACT

Negative-working diazography material is comprised of (i) at least one diazonium compound, (ii) at least one acid labile enolic, preferably phenolic blocked-coupler adapted to be converted in the presence of acid to an active azo-coupling component, (iii) at least one light-sensitive acid progenitor, and (iv) at least one carboxylic acid anhydride. The diazonium compound can itself concurrently function as the acid progenitor, e.g., when complexed with a Lewis acid. Upon imagewise exposure to light, acid catalyst is photochemically liberated, thus unblocking coupler molecules such that dye image forms under alkaline developing conditions only where the material has been irradiated. Under alkaline developing conditions, the anhydride reacts to render the unused diazo component remaining in the unexposed areas inactive.

40 Claims, No Drawings

NEGATIVE IMAGE DIAZOGRAPHY FORMULATION WITH ACID LABILE COUPLER, DIAZONIUM COMPOUND AND CARBOXYLIC ACID ANHYDRIDE

CROSS-REFERENCE TO RELATED APPLICATIONS

This application is a continuation-in-part of my copending application Ser. No. 75,833, filed Sept. 14, 1979, now abandoned, which in turn is a continuation of Ser. No. 902,961, filed May 4, 1978, and now abandoned, which in turn is a continuation of Ser. No. 734,975, filed Oct. 22, 1976, and now abandoned. Cf. commonly assigned Bennett copending application, Ser. No. 066,401, filed Aug. 14, 1979, which in turn is a continuation of Ser. No. 902,960, filed May 4, 1978, now abandoned, itself a continuation of Ser. No. 734,872, filed Oct. 22, 1976, now abandoned.

BACKGROUND OF THE INVENTION

1. Field of the Invention

The present invention relates to negative-working diazotype photoreproduction and, more especially, relates to a revolutionary negative-working diazotype photoreproduction system adapted to utilize conventional diazonium salts and featuring a unique "blocked-coupler" concept.

2. Description of the Prior Art

Diazotype photoreproduction is of course a standard in the graphic arts. The touchstone of the diazography processes is the light-sensitivity of aromatic diazo salts and the fact that such salts undergo two different types of reactions: [1] replacement or decomposition, in which nitrogen is lost or evolves as nitrogen gas and some other atom or group attaches to the benzene ring in its stead; and [2] "coupling", wherein the nitrogen of the diazo function is retained and the salts react with certain couplable color-forming components, i.e., a "coupler" or "azo-coupling component", to effect formation of an azo dye species.

The photochemical sensitivity of the compounds typically employed in diazotype photographic reproduction ["photoreproduction"] materials resides in the near-ultraviolet region of the spectrum, and is centered about 400 nm [nanometers, one nm being equal to a millimicron or $10^{-9}$ meter]. Photographic diazo processes may be divided into two basic categories: positive-working processes and negative-working or reversal, processes. In the former category, the action of light causes photochemical decomposition of the diazo compound. An image is developed in the unexposed areas by the combination of the diazo compound with a "coupling" component, which is generally an aromatic amine, phenol, or aliphatic compound containing active methylene groups, to form colored oxyazo or aminoazo compounds known as azo dyes.

The positive-working material is imaged by first exposing it through a master transparency or original. The light in the exposure step must supply sufficient energy to destroy the diazo compound in the areas corresponding to the clear background of the original. High-pressure mercury vapor lamps are generally used in performing this step. That part of the diazo coating which is unprotected from the ultraviolet radiation by the image on the original becomes a colorless substance, incapable of coupling to form a dye. The unaffected diazo compound which remains in those areas where the light has not struck is able to form an azo dye by reaction with a coupling component when the medium is made alkaline. Thus, wherever there was an opaque line on the original, a dye-line appears on the copy. Positive-working, diazotype photoreproduction material is generally made alkaline, or pH adjusted, either by impregnating the material with ammonia vapors or passing it through an alkaline developing solution. See generally U.S. Pat. Nos. 1,444,469, 1,628,279, 2,217,189, 2,286,701, 2,429,249 and 2,694,009; German Patentschriften Nos. 56,606, 111,416, 487,247 and 515,205; British Patent Specification Nos. 234,818, 281,604 and 521,492.

In the negative-working or reversal process, a dye is formed in the exposed areas, but not in the areas protected from light. See U.S. Pat. Nos. 2,034,508 and 2,095,408; German Patentschriften Nos. 53,455 and 82,239. Thus a negative, or reversed, copy of the original transparency results. Among the processes employing diazo compounds to produce reversal copies are those employing diazosulfonates. Illustrative thereof is U.S. Pat. No. 2,854,338 to Herrick et al., wherein a neutral or acid photosensitive material is exposed to actinic light and developed in ammonia vapors. Residual diazosulfonate is removed from the unexposed areas and the background cleared by washing in water. In accordance with a more recent process, disclosed in U.S. Pat. No. 3,479,183 to Habib et al., an alkaline imaging material is exposed to actinic illumination to convert the diazosulfonate to an active diazonium compound which combines with a coupling component to provide a reverse dye-image. Since the generation of the imaging diazonium is thus accomplished principally by the incident radiation, powerful light sources must be used for exposing the diazotype material. After imaging, the material is acidified and the unreacted diazosulfonate is light-cleared by exposing it to overall actinic illumination, thereby forming colorless decomposition products of the diazosulfonate to produce a stable, negative dye-image against a clear background. Cf. the U.S. Pat. No. 3,713,825 to Girard; U.S. Pat. No. 1,926,322 to Van der Grinten.

Another negative-working process which utilizes diazo compounds to produce azo dye images is the diazo-oxide mode of photoreproduction.

The basic operating differences between the diazosulfonate and diazo-oxide reversal processes are as follow, reference being made to "Decomposition of o-Hydroxy-Diazonium Compounds by Light," J. DeJonge and R. Dijkstra, *Recueil*, 67, (1948) pp. 328–342:

[1] The irradiation product of o-hydroxy benzene diazonium compounds is a cyclopentadiene carboxylic acid while the irradiation product of benzene diazosulfonate is the structurally isomeric diazo compound itself. As a result of the light decomposition, the practical and significant difference between the negative diazosulfonate process and the diazo-oxide reversal process is the fact that a wide variety of azo dye colors may be produced from diazosulfonate coupler combinations whereas only one azo dye may be produced from each diazo-oxide. The cyclopentadiene-carboxylic acid decomposition product couples much more rapidly than phenolic, naphthol or pyrazalone couplers [see page 335, paragraph 2 of the aforementioned article].

[2] The cyclopentadiene carboxylic acid formed as a result of decomposition under actinic light is a very active coupling component and forms red azo dyes with the diazonium compound.

[3] The fixing or prevention of image formation in the unexposed portions of diazo-oxide coated support requires that there be complete elimination of moisture or adjustment of the coated support to extremely high acid levels. This requirement need not be met with certain of the diazosulfonates.

Nonetheless, it too is well known to this art that negative-working diazography based on either diazosulfonate or diazo-oxide chemistry leaves much to be desired in terms of product imaging characteristics, namely, the diazosulfonate films require long exposure times to effect isomerization of the noncoupling trans-isomer to the reactive cis-form needed to provide an azo dye image. Additionally, the need for impractically lengthy fixing exposures likely shall continue to militate against widespread use of this approach. Insofar as the diazo-oxide based films are concerned, same, in effect, generate coupler in situ through partial decomposition of the diazo moiety. The film is cleared by post-development exposure to destroy background diazo. Such film requires vigorous development because of the atypical course of the coupling reaction [the dye is not an arylazo structure of the usual type; rather, it is an allylazo compound akin to the aliphatic structures derived from active methylene couplers like the acetoacets]. The diazo-oxide films are also apparently quite limited in density and re-exposure schemes for enhancing image density by several successive re-exposure/cycles have been proposed. Cf. U.S. Pat. No. 4,108,664 to deBoer et al; U.S. Pat. No. 4,094,681 to Habib et al.

Yet another negative-working system features a "vesicular" film which is exposed to actinic radiation to form a latent nitrogen gas image therein from a preselected master image. The nitrogen gas evolves upon the light decomposition of the diazonium salt; upon storage, the nitrogen would slowly diffuse out of the film. However, upon heating the nitrogen expands and forms small visible bubbles or vesicles in the film. Thus, vesicular imaging is, in reality, a foaming process of sorts; same is essentially confined to single-component systems applicable to projection imaging, or microfiche/-reader uses. Compare, for example, the U.S. Pat. Nos. 3,149,971, 3,355,295, 3,779,768, 3,779,774, 3,841,874 and 3,979,211.

In the U.S. Pat. No. 4,055,425 to Mustacchi, a diazotype material is described comprising a light-sensitive, water-insoluble diazoamino compound, an azo coupler, and an alkaline material, said diazamino compound, when exposed to ultraviolet light, being reactive with said azo coupler to form a visible dye product only at a pH greater than 7. Such diazo-type material can be used for diazotype reproduction processes resulting in either negative or direct positive images. Such material necessitates use of rather exotic equipment and, in the negative-working mode, treatment with an external acid source is mandated, and can be corrosive to the equipment. In addition, the processing entails an extra step in the photoreproduction sequence.

"Thermal" processes are also common to the art; U.S. Pat. Nos. 3,303,028, 3,316,092, 3,499,760, 3,695,885 and 3,899,335.

Compare also the negative-working variant disclosed in the U.S. Pat. No. 3,765,895 to Fox wherein free-radical precursors are activated by photodecomposition of a diazonium salt. This patent features the ability of diazoniums to yield a free-radical by homolytic cleavage of the C-N bond, does not entail the formation of azo dyes or ammonia development, and, indeed, such process is operable even in the absence of diazo salt.

Other variations on the theme are suggested by, e.g., U.S. Pat. Nos. 1,857,920, 2,095,408, 2,381,984, 2,416,021, 2,516,931, 2,976,145, 3,140,180, 3,307,952, 3,331,689, 3,563,744, 3,620,740, 3,769,018 and 3,793,033; British Patent Specification No. 975,457.

Nonetheless, a serious need continues to exist in this art for but a simple negative-working diazography process, and one which is adapted to utilize virtually any of the conventional diazo compounds typically employed to form a positive image.

SUMMARY OF THE INVENTION

Accordingly, a major object of the present invention is the provision of a revolutionary new negative-working diazo-type photoreproduction material, which negative-working diazography material features conventional diazonium salts, but specifically and critically designed enolic, preferably phenolic "blocked-couplers" that are incapable of reacting, or coupling, with the diazonium salt to effect formation of an azo dye until freed of their blocking moiety via an acid catalyzed reaction.

Another object of the present invention is the provision of novel four-component diazography material [I] comprising (i) at least one diazonium compound, (ii) a particular enolic, preferably phenolic blocked-coupler, or precursor of an azocoupling component adapted to be converted in the presence of an acid to an active azo-coupling component, (iii) a photolabile, or light-sensitive acid progenitor, and (iv) a carboxylic acid anhydride capable of inactivating, when subjected to alkaline developing conditions, the unreacted diazonium compound remaining in the formulation after imagewise exposure to light.

Yet another object of the invention is the provision of a preferred three-component diazotype material [II] comprising (i) a complex, light-sensitive salt of a diazonium compound adapted to photolytically cleave to yield an acid species (ia) and a diazonium salt (ib), (ii) a particular enolic, preferably phenolic blocked-coupler, or precursor of an azo-coupling component adapted to be converted in the presence of the acid species (ia) into an active azo-coupling component, and (iii) a carboxylic acid anhydride capable of inactivating, when subject to alkaline developing conditions, the unreacted diazonium compound remaining in the formulation after imagewise exposure to light.

Still another object of the invention is the provision of a uniquely novel negative-working diazography imaging process which comprises the imagewise exposure of either the aforenoted four-component diazography material [I], or the aforenoted three-component diazography material [II], to irradiation, e.g., actinic light, of a quality and quantity sufficient to generate catalytic amounts of acid from either the photolabile acid progenitor [I](iii) or the photolabile salt/diazonium compound [II](i), said catalytic amounts being sufficient to effect conversion of the precursor or the azo-coupling component into an active azo-coupling component, and thence subjecting the thus exposed diazotype material to an alkaline developing environment, thereby enabling (a) the active azo-coupling component formed in the light-struck areas to couple with the diazonium compound to form an azo dye, and (b) the carboxylic acid anhydride to inactivate the unreacted diazonium compound in the unexposed areas by formation of a species which is incapable of further reaction to form azo dye.

Another object of this invention is the provision of novel photosensitive diazotype material comprising any of the conventional diazo compounds typically employed in the art to form a positive image.

Another object of the invention is the provision of novel photosensitive diazotype material which enables direct obtainment of a negative image, without requiring a second printing step to accomplish the sign reversal of the image, and without requiring a separate clearing or fixing step after the alkaline treatment.

DETAILED DESCRIPTION OF THE INVENTION

In one embodiment of this invention, a light-sensitive diazotype reproduction material [I] is provided which comprises (i) at least one diazonium compound, (ii) a precursor of an azo-coupling component adapted to be converted in the presence of an acid to an active azo-coupling component, (iii) a light-sensitive acid progenitor, and (iv) a carboxylic acid anhydride.

In another embodiment of the invention, a light-sensitive diazotype reproduction material [II] is provided wherein at least one of the diazonium compounds is a diazo salt comprising a complex anion of an inorganic Lewis acid, thereby providing by way of a single component both the acid progenitor and the diazonium compound necessary for formation of the azo dye.

In a further embodiment, a negative-working diazo imaging process is provided which comprises imagewise exposing a light-sensitive diazotype material to light to effect generation of an acid catalyst, preferably followed by heating to activate the azo-coupling component [i.e., to effect conversion of a precursor of an enolic or phenolic azo-coupling component to an active azo-coupling component] and then subjecting the thus exposed and heated material to an alkaline developing environment, advantageously also with concomitant heating, with the resultant formation of azo dye in the light struck areas and inactivation of unused diazo component in the areas not exposed to light.

The diazotype reproduction materials of the present invention generally comprise a support such as paper, film or other suitable support bearing thereon a light-activatable coating which includes at least one diazonium compound; a precursor of an azo-coupling component which is capable of being converted in the presence of an acid to an active azo-coupling component; a carboxylic acid anhydride; and, if necessary, an additional component which functions as a light-sensitive acid progenitor. The diazonium compound is preferably incorporated as a salt comprising a complex anion of an inorganic Lewis acid; and, as hereinbefore indicated, when the diazonium compound is incorporated as the salt of said complex anion, the diazonium compound can function as the acid generating compound as well, since such compound will liberate catalytic amounts of Lewis acid upon imagewise exposure.

The diazotype materials of the present invention can be coated as a single layer on a support or in more than one layer on a support. In accordance with a one layer arrangement, a single layer is coated on a support. The single layer can contain the diazonium compound, the precursor of an azo-coupling component, the carboxylic acid anhydride, and the acid progenitor, if said progenitor is a compound other than a diazonium salt. Multi-layer coatings can also be utilized wherein separate diazonium containing and precursor containing layers are utilized. Thus the photographic speed and contrast of the resultant diazotype material can be controlled and varied by the use of diazonium compounds exhibiting different spectral responses in different layers of the diazotype material.

The imaging process according to the present invention utilizes a negative-working diazonium process that involves two essential process steps; namely, the imagewise exposure to light, typically in the UV or blue region of the spectrum [e.g., for from 8–12 seconds; with certain formulations, however, exposure times of 3 seconds or less are fully operative], and a weak moist ammonia atmosphere development. In a preferred embodiment of the present invention, the process also includes a heating step, e.g., to a temperature of from 100° to 200° F., preferably from 120° to 190° F., after the exposure step, which enhances the intensity of the image which is ultimately obtained, and the development chamber is also preferably heated. According to the method of the present invention, a negative image is obtained directly from the diazonium material without requiring a second printing step to accomplish the sign reversal of the image as with positive-working diazo in conjunction with silver. In the unexposed portions of the diazotype material, the presence of the acid anhydride insures the conversion of the light-sensitive diazonium compound to a form which is inactive as an acid progenitor where the diazotype material is thereafter exposed to light. Thus, one advantage of the present material and process over existing systems is the relatively simple processing required and especially the elimination of the clearing or fixing step. The presence of the acid anhydride thus eliminates any need for a separate clearing step (e.g., exposure overall to actinic light for about 60 seconds to clear the background) to insure complete destruction of diazo salt and preclude subsequent azo dye formation.

Another advantage of the present material and process is that the development does not exude toxic vapors in the exposure or processing steps. An additional advantage of the present material is that photographic speeds greater than those possible with existing diazo films can be obtained. This increase in photographic speed, or "gain", is a result of the catalytic reaction of the acid released upon imagewise exposure which in turn reacts with the precursor compound in the light-sensitive layer to form a coupling component which is then available for coupling with the diazonium compound to form an azo dye. Moreover, potential exists for sensitization in specific regions of the spectrum.

More particularly according to this invention, there is featured a photochemically induced removal of the "blocking" group from the enolic, preferably phenolic oxygen of certain enolic or phenolic blocked-couplers, such that a dye image will form only where there has been irradiation. Selective photolysis can be effected by use of appropriate filters in the exposure device. The subject invention chemically differs from the conventional and known negative-working diazography techniques in that, while being adapted to the utilization of the conventional diazonium salts, specifically designed and predetermined enolic, preferably phenolic couplers are critically required, which couplers are incapable of reacting with any diazonium salt present to effect formation of an azo dye up and until such time as acid catalysis has unblocked the active enolic or phenolic coupler species. The acid for the unblocking reaction, typically and preferably either a Lewis or Brönsted acid, derives from a photolabile or light-sensitive acid progenitor which either may [in the preferred three-component diazotype material] or may not [in the four-component diazotype material] comprise the diazonium salt itself.

The Blocked-Couplers

Thus, it will be apparent that only these enolic, preferably phenolic blocked couplers are envisaged herein as comprise an acid sensitive or labile oxygen bridge to the "blocking" moiety.

Such preferred phenolic blocked couplers are of the genera: tertiary ethers, and the various acetal, ketal and MEM ether derivatives of phenols. The tertiary ether phenols comprise a tert-blocking group linked through an acid labile bond via an oxygen atom to an aryl coupler moiety and have the structural formula:

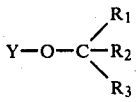

[I]

wherein each R, which may be the same or different but which cannot be hydrogen, is alkyl, preferably straight or branched chain lower alkyl of from 1 to 8 carbons; alkenyl, preferably lower alkenyl of from 2 to 8 carbons; lower alkynyl; aryl, preferably aryl of from 6 to 10 carbons; cycloalkyl, preferably cycloalkyl of from 3 to 8 carbons; cycloalkenyl, preferably cycloalkenyl of from 3 to 8 carbons; aralkyl and alkaryl, and aralkenyl and alkenylaryl, wherein alkyl, aryl and alkenyl are as above defined; and wherein Y is aryl, e.g., phenyl, naphthyl, anthryl, phenanthryl, and the like. Moreover, any two or three of said R substituents may be linked together to form a tertcyclic, bicyclic or heterocyclic structure. Also, any one or more of the R and Y moieties may itself or themselves be substituted by any one or more substituents not atypical to diazotype photoreproduction components, and which will not interfere with the acid catalyzed unblocking chemistry above described.

The active derivatives have the structural formula:

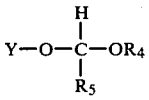

[II]

and the ketal derivatives, the structural formula:

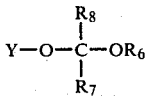

[III]

wherein Y and each R, which also may be the same or different, are as above defined, except that in the formula [II] the $R_5$ moiety, but not $R_4$, can also be hydrogen. Also as above defined, any two or three of said R substituents may be linked together to form a cyclic, bicyclic or heterocyclic structure. Similarly, the various Y and R moieties may be either substituted or unsubstituted.

Additionally, in the above formulae [I], [II] and [III], any R and Y may be taken together to define a fused or polycyclic basic nucleus, e.g., naphthyl or diphenyl, and R may even be Y.

Also included are compounds of the type:

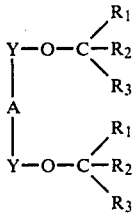

[IV]

wherein each R is as above defined and A is any suitable bridging atom, group, e.g., alkylene, or direct chemical bond.

The MEM ether acetals are especially attractive and correspond to those having the structural formulae:

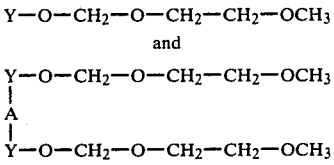

[V]

and

[VI]

wherein Y is as above defined.

Representative blocked-couplers thus include the following:

| Structure | Chemical Name |
|---|---|
| 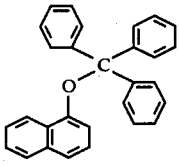 | 1-naphthyl triphenylmethyl ether |
| 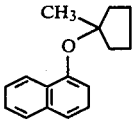 | 1-methylcyclopentyl 1-naphthyl ether |
| 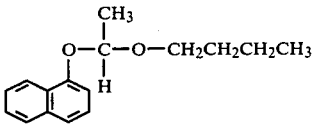 | 1-butoxy-1-(1-naphthoxy)ethane |
| 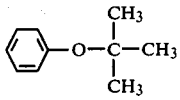 | t-butyl phenyl ether |
| 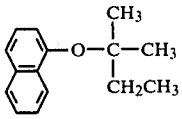 | 2-(1-naphthoxy)-2-methylbutane |
| 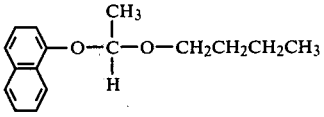 | 1-(1-butoxy)-1-(1-naphthoxy)ethane |

-continued

| Structure | Chemical Name |
|---|---|
| 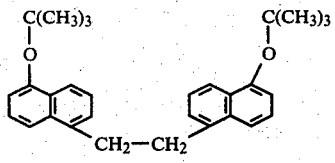 | 1,2-bis(5-t-butoxy-1-naphthyl)ethane |
| 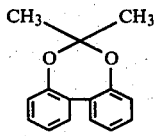 | Dibenzo(d,f)-2,2-dimethyl-1,3-dioxepine |
| 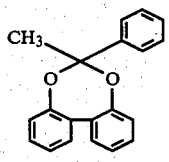 | Dibenzo(d,f)-2-methyl-2-phenyl-1,3-dioxepine |
| 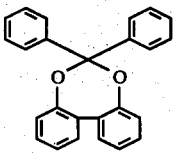 | Dibenzo(d,f)-2,2-diphenyl-1,3-dioxepine |
| 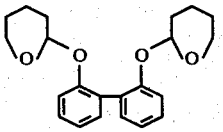 | 2,2'-di(2-tetrahydro-pyranoxy)diphenyl |
| 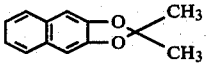 | 2,3-isopropylidene-dioxynaphthalene |
| 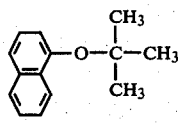 | t-butyl 1-naphthyl ether |
| 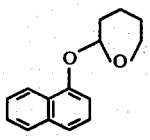 | 1-naphthyl 2-tetra-hydropyranyl ether |
| 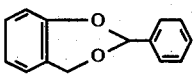 | Benzo(e)-2-phenyl-1,3-dioxin |
| 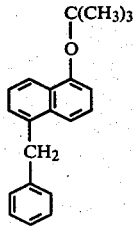 | 1-t-butoxy-5-benzyl-naphthalene |
| 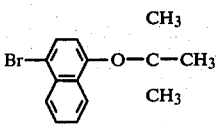 | t-butyl (4-bromo-1-naphthyl) ether |
| 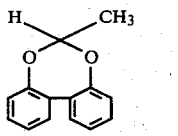 | Dibenzo(d,f)-2-methyl-1,3-dioxepine |

-continued

| Structure | Chemical Name |
|---|---|
| 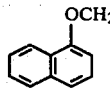 | β-methoxyethoxy-methyl α-naphthyl ether |

Other suitable blocked-couplers include those of the structural formulae:

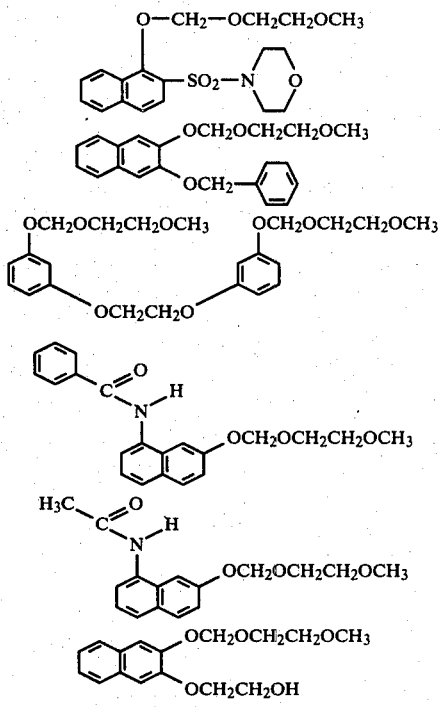

Representative enolic blocked-couplers, for example, would generically include those comprising the basic nucleus:

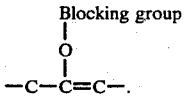

A very important aspect of the present invention beyond the negative photographic image produced is the ability of the chemistry involved to provide substantial photographic gain though the use of catalyzed reactions, i.e., photogeneration of one molecule of catalyst can lead to the unblocking of many coupler molecules and hence afford image amplification.

The Light-Sensitive Acid Progenitor

One diazo reproduction formulation of the invention requires that a light-sensitive acid progenitor be present in the coating formulation with the diazonium compound and precursor of an azo-coupling component. This is conveniently accomplished by the addition of an acid progenitor, which is photolabile, to the coating formulation, e.g., $CHI_3$ or

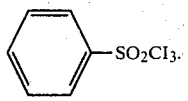

Other suitable acid progenitors include the triarylsulfonium and diaryliodonium salts disclosed in Crivello et al, *J. Radiation Curing*, 4(3), 2 (1977) and 5(1), 2 (1978). In a further and preferred embodiment of the invention, the number of essential components is reduced to three by the use of a diazonium compound which is a salt comprising a complex anion of a Lewis acid. Such compounds are capable of photolytically generating an acid species which is then capable of catalytically rearranging or cleaving a precursor as more fully described, infra. The Lewis acid is an electron pair acceptor such as $SnCl_4$, $PF_5$, $BF_3$ etc., which, upon imagewise exposure of the diazonium complex salt is released in substantial quantities and initiates or catalyzes the molecular rearrangement or cleavage of the precursor of the azo-coupling component, thereby forming a compound that can couple in conventional fashion under alkaline developing conditions.

The Diazonium Compound

As stated above, any of the known diazonium compounds capable of forming a positive image in a conventional diazo element are suitable for producing a negative image in the diazo formulation of the present invention, which approach marks a revolutionary advance in this art. Exemplary diazonium compounds include those formed from the following list of cations and anions.

TABLE I

Illustrative of the aromatic diazonium cations comprising the photosensitive salts utilized in accordance with the present invention are the following:

(1) p-Chlorobenzenediazonium;
(2) 2,4-Dichlorobenzenediazonium;
(3) 2,5-Dichlorobenzenediazonium;
(4) 2,4,6-Trichlorobenzenediazonium;
(5) p-Methoxybenzenediazonium;
(6) o-Methoxybenzenediazonium;
(7) 2-Chloro-4-(dimethylamino)-5-methoxybenzenediazonium;
(8) 4-Chloro-2,5-dimethoxybenzenediazonium;
(9) 2,4,5-Triethoxy-4-biphenyldiazonium-[2,5-diethoxy-4-(p-ethoxyphenyl)benzenediazonium];
(10) 2,5-Dimethoxy-4'-methyl-4-biphenyldiazonium[2,5-dimethoxy-4-(p-tolyl-benzenediazonium];
(11) 2,5-Diethoxy-4-(phenylthio)benzenediazonium;
(12) 2,5-Diethoxy-4-(p-tolylthio)benzenediazonium;
(13) p-Morpholinobenzenediazonium;
(14) 2,5-Dichloro-4-morpholinobenzenediazonium;
(15) 2,5-Dimethoxy-4-morpholinobenzenediazonium;
(16) 4-(Dimethylamino)-naphthalenediazonium.

Illustrative of suitable anions whose salts may be utilized in accordance with the present invention include the following:

(1) Tetrafluoroborate, $BF_4-$;
(2) Hexafluorophosphate, $PF_6-$;
(3) Hexafluoroarsenate(V), $AsF_6-$;
(4) Hexafluoroantimonate(V), $SbF_6-$;
(5) Pentachlorobismuthate(III), $BiCl_5^{2-}$;
(6) Stannous chloride, $SnCl_3-$;
(7) Chlorozincate, $ZnCl_3-$.

Preferred diazonium compounds include those listed in the following Table II.

TABLE II (1) p-N-Diethylaminobenzenediazonium hexafluorophosphate;
(2) 3-Chloro-4-N-diethylaminobenzenediazonium hexafluorophosphate;
(3) o-Chlorobenzenediazonium hexafluorophosphate;
(4) 4-N-Diethylamino-2-ethoxybenzenediazonium hexafluorophosphate;
(5) 4-N-diethylamino-2-methylbenzenediazonium hexafluorophosphate;
(6) p-N-Dimethylaminobenzenediazonium hexafluorophosphate;
(7) 2,5-Diisopropoxy-4-morpholinobenzenediazonium hexafluorophosphate;
(8) 4-(3,5-Dimethylmorpholino)benzenediazonium hexafluorophosphate;
(9) o-Methoxybenzenediazonium hexafluorophosphate;
(10) 3-Chloro-4-N-pyrrolidinobenzenediazonium hexafluorophosphate;
(11) 3-Methyl-4-N-pyrrolidinobenzenediazonium hexafluorophosphate;
(12) 3-Methoxy-4-N-pyrrolidinobenzenediazonium hexafluorophosphate;
(13) 5-Methoxy-2-N-pyrrolidinobenzenediazonium hexafluorophosphate;
(14) 2,4-Dimethoxybenzenediazonium hexafluorophosphate;
(15) 2,5-Diethoxy-4-[4'-chlorophenoxy]benzenediazonium hexafluorophosphate;
(16) 4-Benzyloxybenzenediazonium hexafluorophosphate;
(17) 2,5-Diethoxy-4-N-benzamidobenzenediazonium hexafluorophosphate;
(18) 2-Methoxy-5-methyl-4-N-benzamidobenzenediazonium hexafluorophosphate;
(19) p-Ethoxybenzenediazonium hexafluorophosphate;
(20) 4-Chloronaphthalenediazonium hexafluorophosphate;
(21) 4-Pyrrolidinonaphthalenediazonium hexafluorophosphate;
(22) 2,5-Diisopropoxy-4-morpholinobenzenediazonium tetrafluoroborate;
(23) 4-(3,5-Dimethylmorpholino)benzenediazonium tetrafluoroborate;
(24) 4-N-Diethylamino-2-ethoxybenzenediazonium tetrafluoroborate;
(25) 2,4-Dimethoxybenzenediazonium tetrafluoroborate;
(26) p-Chlorobenzenediazonium tetrafluoroborate;
(27) 2,4-Dimethoxybenzenediazonium chlorozincate;
(28) 4-(3,5-Dimethylmorpholino)benzenediazonium chlorozincate;
(29) 4-N-Diethylamino-2-ethoxybenzenediazonium chlorozincate.

Other suitable diazonium/complex anion salts include those of the structural formulae:

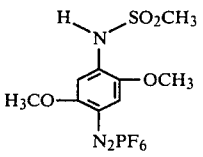

-continued

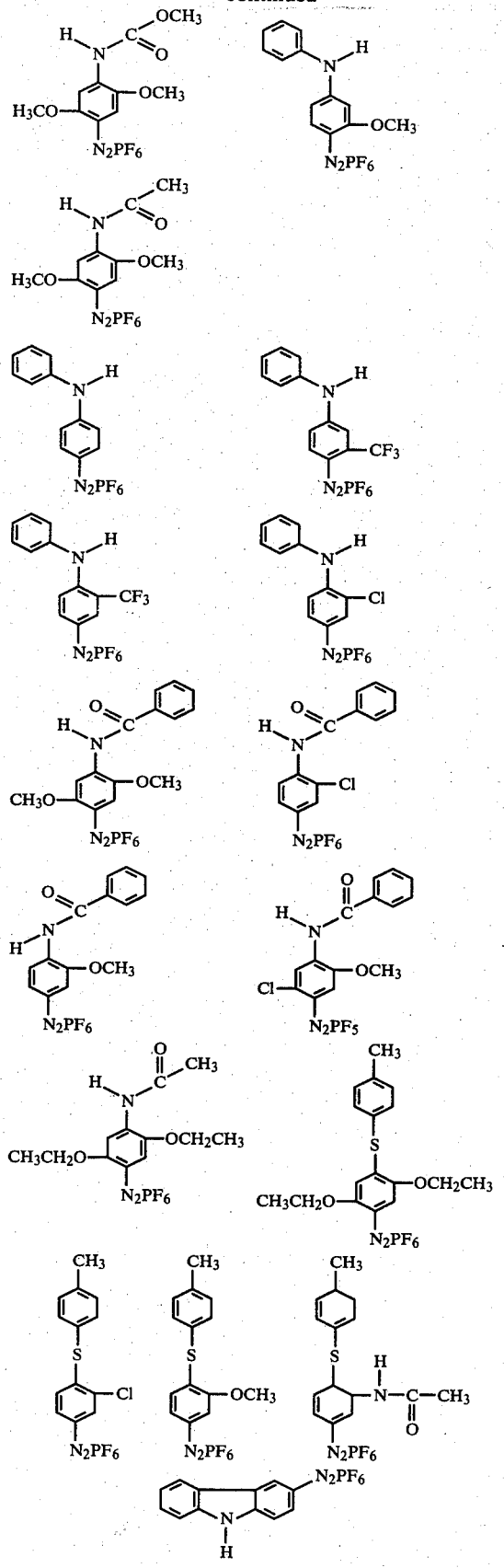

THE ANHYDRIDE

The diazo reproduction formulation of the invention requires that a carboxylic acid anhydride be present in the formulation with the diazonium compound, the acid progenitor and the blocked-coupler. Useful anhydrides may include maleic, succinic, glutaric, isatoic, naphthoic, phthalic, mellitic, acetic, glycolic, benzoic and butyric anhydrides or substituted derivatives of such anhydrides. Expecially preferred anhydrides include those listed in Table III below. From the list below, the nature of typical substituents will be readily apparent. Obviously, only those substituents which will not have an adverse effect on any of the reactions which take place upon exposure to light and subsequent development are contemplated.

TABLE IV

| | |
|---|---|
| Maleic Anhydrides | |
| Maleic anhydride | 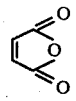 |
| Bromomaleic anhydride | 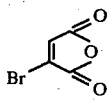 |
| Chloromaleic anhydride | 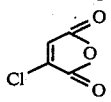 |
| Dichloromaleic anhydride | 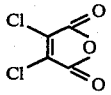 |
| Citraconic anhydride | 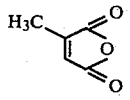 |
| 2,3-Dimethylmaleic anhydride | 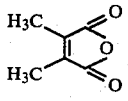 |
| Succinic Anhydrides | |
| Succinic anhydride | 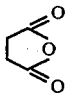 |
| Tetramethyl succinic anhydride | 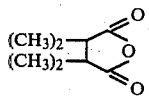 |
| Itaconic anhydride | 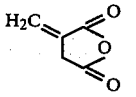 |
| Methylsuccinic anhydride (pyrotartaric anhydride) | 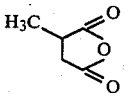 |
| 2-Dodecen-1-ylsuccinic anhydride | 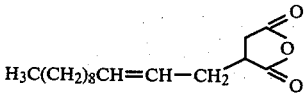 |
| Glutaric Anhydrides | |
| Glutaric anhydride | 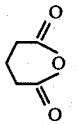 |

TABLE IV-continued

| | |
|---|---|
| 3-Methylglutaric anhydride | 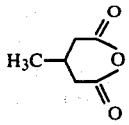 |
| α,α-Dimethylglutaric anhydride | 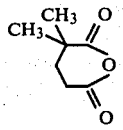 |
| β,β-Dimethylglutaric anhydride | 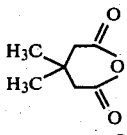 |
| α,α,γ,γ-Tetramethylglutaric anhydride | 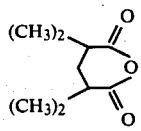 |
| 1-1-Cyclopentane diacetic anhydride (3,3-tetramethylene glutaric anhydride) | 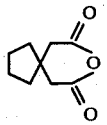 |
| Isatoic Anhydrides | |
| Isatoic anhydride | 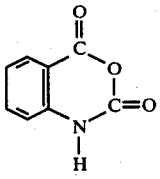 |
| 5-Chloroisatoic anhydride | 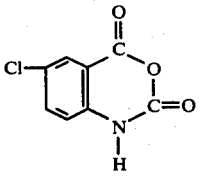 |
| N-Methylisatoic anhydride | 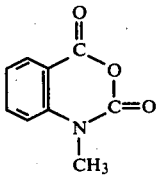 |
| Naphthoic Anhydrides | |
| 1,8-Naphthoic anhydride | 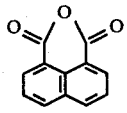 |
| 1,4,5,8-Naphthalene tetracarboxylic dianhydride | 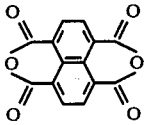 |
| Phthalic Anhydrides | |
| Phthalic anhydride | 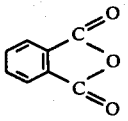 |
| cis-1,2-Cyclohexanedicarboxylic anhydride (cis-hexahydrophthalic anhydride) | 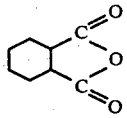 |
| cis-1,2,3,6-tetrahydrophthalic anhydride | 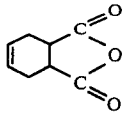 |
| 3,4,5,6-tetrahydrophthalic anhydride | 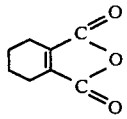 |
| Tetraphenylphthalic anhydride | 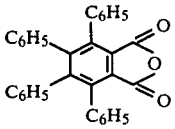 |
| Tetrachlorophthalic anhydride | 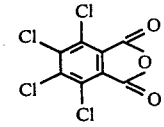 |
| Tetrabromophthalic anhydride | 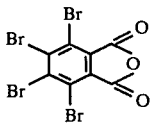 |
| Hexahydro-4-methylphthalic anhydride | 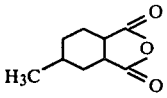 |
| 3,6-Endoxo-1,2,3,6-tetrahydrophthalic anhydride | 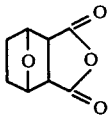 |
| 3,3',4,4'-Benzophenonetetracarboxylic dianhydride (4,4'-carbonyldiphthalic anhydride) | 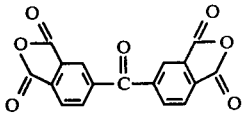 |
| 1,3-Isochromandione (Homophthalic anhydride) | 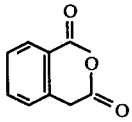 |
| Mellitic Anhydrides | |
| Mellitic Trianhydride | 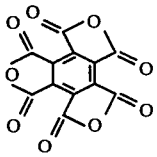 |
| 1,2,4-Benzenetricarboxylic anhydride (trimellitic anyhydride) | 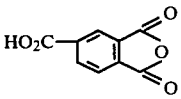 |
| 1,2,4,5-Benzenetetracarboxylic anhydride (pyromellitic anhydride) | 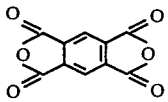 |
| Acetic Anhydrides | |
| Acetic anhydride | 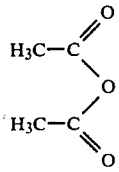 |
| Glycolic Anhydrides | |

TABLE IV-continued

| | |
|---|---|
| Diglycolic anhydride | 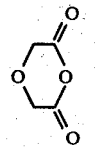 |
| Benzoic Anhydrides | |
| Benzoic anhydride | 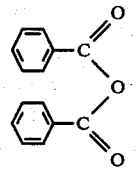 |
| Cinnamic anhydride | 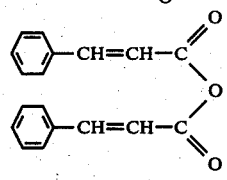 |
| Misc. Anhydrides | |
| cis-1,2-cis-3,4-Cyclopentane tetracarboxylic anhydride | 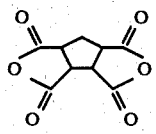 |
| 3,4,9,10-Perylenetetracarboxylic dianhydride | 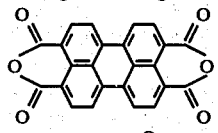 |
| endo-Bicyclo[2 . 2 . 2]octa-5-ene-2,3-dicarboxylic anhydride | 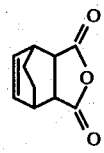 |
| Bicyclo[2 . 2 . 2]oct-7-ene-2,3,5,6-tetracarboxylic-2,3,5,6-dianhydride | 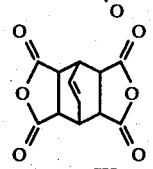 |
| dl-Camphoric anhydride | 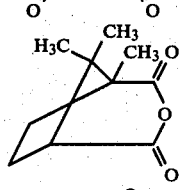 |
| cis-1,2-Cyclobutane dicarboxylic anhydride | 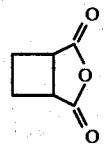 |
| 1,2,3,4-Cyclobutanetetracarboxylic dianhydride | 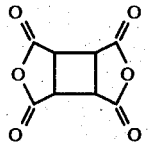 |
| Tetrahydrofuran-2,3,4,5-Tetracarboxylic dianhydride | 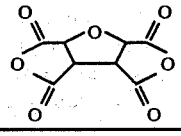 |

From the foregoing, it will be appreciated that the use of certain specifically designed, acid labile tert-ether and related derivatives of enolic, preferably phenolic compounds as blocked-couplers in a diazo dye imaging chemistry, to obtain a negative-working system, marks a radical departure in the art of diazotype photoreproduction. Again, one basic requirement of this invention is the ability to photochemically induce removal of the blocking group from the enolic or phenolic oxygen of the coupler molecule, such that dye image forms only where there has been irradiation. An especially desirable feature of the invention is the ability to provide substantial photographic gain via acid catalyzed reactions, i.e., photogeneration of one molecule of catalyst effects unblocking of many coupler molecules and, hence, affords image amplification. For example, it has been found that, when utilizing diazotype material according to the invention comprising stoichiometric amounts of diazo compound and coupler, that exposure photolysis of, e.g., about 10% of a photosensitive diazo/acid complex will result in 100% consumption of the coupler fraction. Thus, the acid catalyzed gain.

While not wishing to be bound to or by any particular theory or mechanism of reaction, it is likely that the photochemically induced removal of the blocking group from the enolic or phenolic oxygen of the coupler molecule, resulting in the formation of dye image only in the light-struck areas, can proceed either by intramolecular rearrangement of the coupler molecule, or via the acid cleavage thereof. For example, in a three-component diazotype material according to the invention [wherein the diazonium compound is a light-sensitive anion salt adapted to itself photolytically cleave, in situ, to yield the acid catalyst] comprising, in addition to the requisite carboxylic acid anhydride, the following illustrative ingredients:

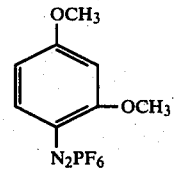

The Diazonium Compound

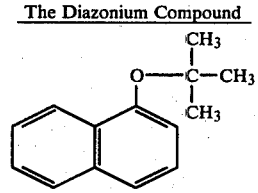

The Blocked-Coupler it is thought that the imagewise exposure of such material for a period of time, e.g., for from 8 to 12 seconds, photolytically decomposes enough diazonium compound, typically from 10% to 20%, as to release catalyzing amounts of Lewis acid according to the sequence:

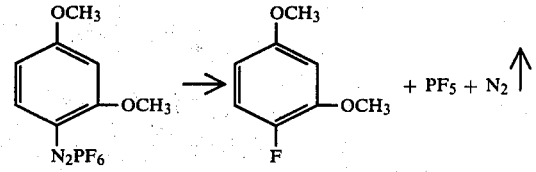

and whereafter the $PF_5$ complexes with the blocked coupler, thus:

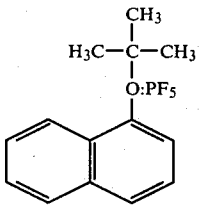

ultimately effecting the intramolecular rearrangement, desirably thermally accelerated, of the blocked coupler into the active coupler species:

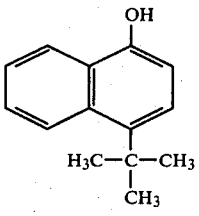

and/or effecting acid cleavage thereof into the likewise active coupler species:

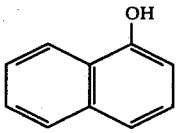

The diazotype material is next conventionally developed by subjecting same to a typical alkaline developing environment, e.g., moist ammonia, to form a dye image by reaction between the active coupler species and the unconverted diazo only in the light-struck area, as follows:

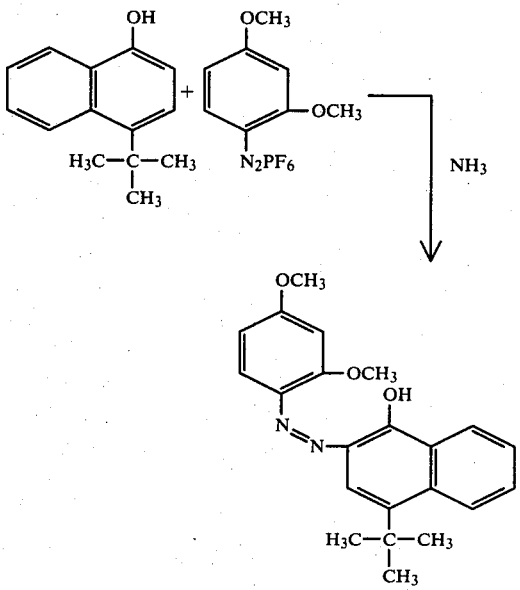

, and

-continued

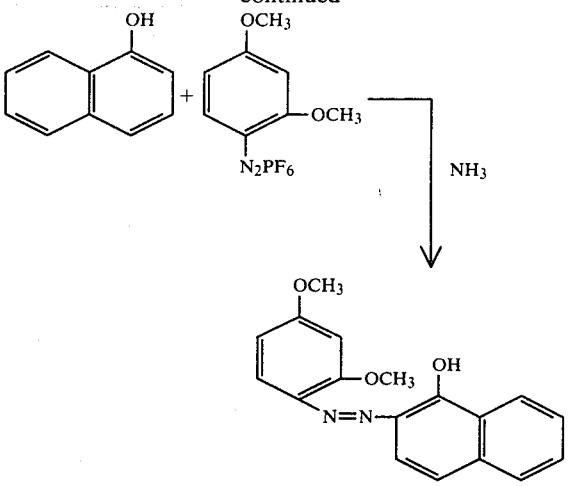

Obviously, other than para-position intramolecular rearrangement is possible, and other isomeric dye forms too are envisaged.

When the diazotype material of the present invention is developed by being subjected to moist ammonia or other typical alkaline developing environment, the role of the carboxylic acid anhydride comes into play. Thus, it is believed that the anhydride undergoes ring opening when exposed to ammonia vapor to give monoamide and monocarboxylate anion with ammonium cation. The carboxylate anion then exchanges rapidly with unreacted diazo anion in the unexposed areas to yield new species which cannot generate acid upon decomposition of the diazo, thus rendering the diazo inactive for further reaction with the specified system. Consequently, a diazotype material of the present invention will now show any increase in image or color density after a second exposure and development as compared to the image and color density after the initial treatment because the anhydride will have deactivated any unreacted diazo during the initial development step. The presence of the anhydride also eliminates any need for a separate clearing or fixing step after the alkaline development step. Furthermore, during storage of unexposed material, the activated form of the anhydride will react with any excess or unwanted unblocked or otherwise free coupler so that such coupler will also be rendered incapable of undesired subsequent reaction.

It too will be appreciated that in a four-component embodiment according to the invention, wherein the light-sensitive acid progenitor is a fourth distinct component, e.g., iodoform, and the diazo compound, thus, need not itself function as the acid progenitor, the basic chemistry remains the same, i.e., when irradiated imagewise the iodoform photolyzes and yields hydriodic acid (Bronsted acid) as one of the photolysis products. The acid catalyzes rearrangement and/or cleavage of the blocked phenolic coupler in the image area so that on subsequent ammoniation a dye image is formed only in the previously illuminated area, namely:

$$CHI_3 \xrightarrow[\text{radiation}]{\text{actinic}} HI + \text{other products}$$

-continued

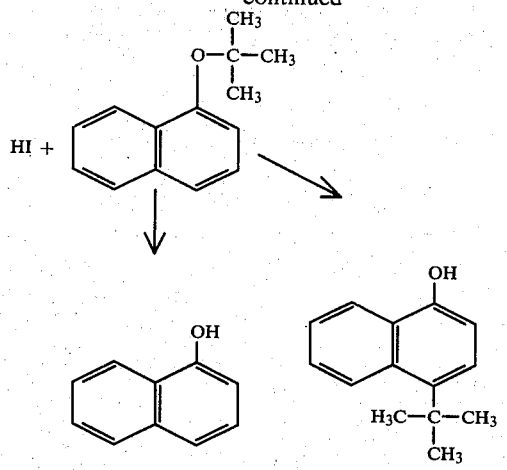

It too is thought that, due to the hygroscopicity of the subject diazotype materials, or due to ambient or other humidity, the following mechanisms provide for the generation of a plurality of unblocking Brönsted or protonic acid molecules (and hence "gain") from but a single molecule of Lewis acid; for example:

$$PF_5 \xrightarrow{4H_2O} 5HF + H_3PO_4$$

or $$PF_5 \xrightarrow{H_2O} POF_3 + 2HF$$

$$POF_3 \xrightarrow{3H_2O} 3HF + H_3PO_4$$

Thus, as regards the Brönsted acids and possible aqueous reactions thereof in the context of the invention, the following are submitted as likely candidates, using HCl as representative and wherein $\phi$ is phenyl and R is a tert-butyl group:

$$\phi{-}O{-}R + H_3O^{\oplus}\,Cl^{\ominus} \rightleftharpoons \phi{-}\overset{H}{\overset{|}{O}}{}_{\oplus}{-}R + Cl^{\ominus} + H_2O \quad \text{(i)}$$

$S_N2$ Scission $$\phi{-}\overset{H}{\overset{|}{O}}{}_{\oplus}{-}R \xrightarrow{Cl^{\ominus}} \phi{-}OH + RCl \quad \text{(ii)}$$

$S_N1$ Scission $$\phi{-}\overset{H}{\overset{|}{O}}{}_{\oplus}{-}R + H_2O \longrightarrow \phi{-}OH + ROH + H^{\oplus} \quad \text{(iii)}$$

In the latter scission, the product will reflect the relative rate constants for ion rearrangement, attack by each nucleophile present, and elimination. Step (ii) above is a stoichiometric cleavage, whereas step (iii) is a catalyzed reaction. An obvious difference between the two possibilities is that the catalyzed sequence provides a gain mechanism and may also yield a high gamma photographic system.

In any event, in light of the fact that all coupler is consumed upon photolysis of but, e.g, 10% of stoichiometric amount of photolabile diazo/Lewis acid progenitor, it is clear that the overall chemistry is acid catalyzed. The Lewis acid [$PF_5$] can effect the intramolecular rearrangement of the blocked coupler molecule; a recycling of same through the system would provide gain. As previously mentioned, it is likely that some catalysis is by the $PF_5$ and some via hydrolysis products.

It will also be appreciated that, while the coupler and diazo molecules may bear any one or more substituents which will not interfere with the acid catalyzed unblocking chemistry, at least two sites must be available on the blocked-coupler for any rearrangement and for the subsequent coupling of the unblocked molecule to form azo dye. Similarly, no acid scavenging moieties should be present on any of the components, as such would interfere with the acid catalyzed unblocking chemistry.

The diazotype photoreproduction material according to the invention is conveniently produced by first preparing a solution in pure organic solvents of either the four, or preferably the three, essential components, i.e., a solution of either the diazo/blocked-coupler/light-sensitive acid progenitor/carboxylic acid anhydride four components, or of the diazo complex anion/-blocked-coupler/carboxylic acid anhydride three components. The preferred solvents are low molecular weight ketones and alcohols because same, e.g., are typically good solvents for the hexafluorophosphate and tetrafluoroborate diazonium salts. In practice, it is of advantage to utilize a mixture of ketone and alcohol solvents. Also advantageously, in the three-component system, the coupler precursor is dissolved in the solvent solution with moderate mechanical stirring, then the diazonium salt is added and dissolved in a similar manner, and then the anhydride although the components may indeed be added in any order. The four-component system is formulated in like manner. Any additives/-stabilizers are then slowly stirred into the solution and the mix is filtered to remove insoluble particulates like dust.

While the amounts of the respective components formulated are not especially critical, it has been determined that incorporation of the diazo in amounts of up to 7 parts by weight per 100 g of total mix is eminently practicable, preferably not less than 0.5 parts by weight of total mix. The blocked-coupler is typically incorporated in a ratio of about 0.1 moles per mole dizo, to about 2.0 moles per mole diazo [whether the "simple" salt or the complex anion]. A likewise typical amount of the acid progenitor would be on the order of 10% of the amount of diazo.

In a preferred embodiment of the invention, the mix contains a quantity of precursor of approximately 1.0 mole of blocked-coupler per approximately 1.0 mole of diazo.

The anhydride is generally effective in quantities ranging from 0.5 mole per mole diazo to 1.5 moles per mole diazo, with the optimum quantity being specifically related to the particular anhydride structure. In a preferred embodiment, the ratio of anhydride to diazo employed is equimolar, i.e., 1.0 mole of anhydride to 1.0 mole of diazonium salt. After exposure to light, and subsequent ammoniation, there must be sufficient carboxylate ion to consume unreacted diazo. While it is possible to calculate for any specific image, depending on how much diazo will be consumed, a molar ratio of anhydride less than the initial moles of diazo, an excess of anhydride (e.g., 1 mole anhydride/1 initial mole of diazo) assures completeness of the reaction.

Conveniently, the immediately aforesaid mix is applied to any suitable base substrate, e.g., cellulose acetate butyrate, cellulose acetate propionate, ethyl cellulose, silica/polyvinylbutyral, and preferably to coatings of the aforementioned materials borne by a transparent or opaque polyethylene terephthate (polyester) film base, by imbibition or bead coating such that approximately 30 grams of mix are laid down per square yard. This consumption varies according to the specific components utilized, the type and thickness of the polymer precoating, and the image density desired. Preferably, the subbed base is overcoated with a layer of cellulose ester, ether, or the like; or the coating can itself comprise a like matrix resin in addition to the solution of the imaging chemicals. A representative film prepared according to the invention would comprise a 0.92–7 mil bond coated polyester base, overcoated with, e.g., a 0.25 mil matrix resin (for example, cellulose acetate propionate) overcoating including the imaging chemicals. Other suitable substrates include the conventional diazo paper bases, textile substrates, nonwovens, etc. See generally the U.S. Pat. No. 3,976,491 to Desjarlais.

While the imaging components may all be coated in a single layer, a coating of this type may employ two or more diazonium salts to improve photo-speed, contrast or color, or it may contain more than a single blocked-coupler.

Conversely, the components may be in separate layers. For example, the diazonium salt and the anhydride may be coated in a single layer on a support, and then the coupler precursor and a second diazonium incorporated in a separate layer above this first layer. To vary the photo-speed, contrast and/or the color of the image, various other layered systems may be employed.

The shelf life of a particular type of film according to the invention will be optimized by coating the diazonium reactant in a resin layer separate from that containing the anhydride, blocked-coupler and the acid progenitor, thus diminishing any potential interaction between adventitiously generated acid and the blocked-coupler.

Specifically to control the contrast, a small amount of amine or other basic material may be included in the barrier layer or with the couplers.

It will be appreciated that, in the four-component diazotype material, a diazonium salt can be used whose spectral sensitivity is at lower wavelengths than the light used to generate the acid required to unblock the coupler.

In order to further illustrate the present invention and the advantages thereof, the following specific examples are given, it being understood that same are intended only as illustrative and not limitative.

EXAMPLE I

Representative Synthesis Of A Blocked-Coupler; t-Butyl Ether of α-Naphthol:

20.7 g. (0.1 mole) of α-bromonaphthalene dissolved in 80 ml. of tetrahydrofuran were reacted with 2.4 g. (0.1 g. atom) of magnesium turnings to form the Grignard reagent. To this was added dropwise a solution of 19.4 g. (0.1 mole) of t-butyl perbenzoate in 20 ml. of tetrahydrofuran. When the exothermic addition was complete, the solution was refluxed for one-half hour.

After cooling, the material was worked up by addition to water and extraction into benzene. Some diethyl ether and dilute hydrochloric acid were added to break a benzene-water emulsion during the extraction; therefore, the final organic layer was washed with sodium bicarbonate solution prior to drying over sodium sulfate. Removal of the solvent on a rotary evaporator afforded 24 g. of light amber color liquid (theoretical yield, 20 g.) whose infrared spectrum showed no hydroxyl absorption and contained the expected phenyl ether band.

EXAMPLE II

A solution of the following was prepared by dissolving the coupler precursor, the diazonium salt, and then the anhydride in an acetone and methanol solution:

| Ingredient | Amount (grams) |
|---|---|
| methanol | 40 |
| acetone | 60 |
| (coupler precursor) t-butylα-naphthyl ether | 2.8 |
| 2,3-dimethoxybenzenediazonium hexafluorophosphate | 4.0 |
| 2,3-dimethylmaleic anhydride | 1.9 |

The resultant solution was then imbibition coated onto cellulose proprionate subbed polyethylene terephthalate and dried in an oven at 170° C. for 3 minutes.

To demonstrate the effectiveness of the anhydride, the same formulation without the anhydride was similarly prepared and coated. The two coated materials were then partially covered with an actinically opaque material and exposed for 75 seconds to ultraviolet light from a 2,000 watt mercury-gallium lamp at a distance of 30 inches. These materials were next subjected to a temperature of 82° C. for 10 seconds in a hot roller type heater and then passed through moist ammonia vapor at 66° C. in a typical diazotype processor. The maximum density generated in the exposed area was 2.32 on the control sheets and 2.43 on the anhydride-containing sheet. The minimum density in the nonexposed area was 0.44 on the control sheet and 0.47 on the anhydride-containing sheet, as measured with a MacBeth densitometer with an 18A filter.

EXAMPLE III

The materials prepared as in Example II were placed in the exposure unit and a portion of the area was covered. The identical exposure and processing were again given these films. The density readings for the control and the anhydride-containing film respectively were:

in the exposed area—2.37, 2.53 in the area given no exposure—0.46, 0.50

The covered portion was then reexposed in a second exposure-development cycle. The areas given an exposure during the second cycle had a density of 2.18 (sepia color) on the control film and a density of 0.54 (yellow in tint) on the film containing the anhydride. These results indicated that the diazo initially unused (i.e., nonexposed) did not form an image in the presence of the anhydride upon reexposure and development.

EXAMPLE IV

The anhydride of Example II (2,3-dimethylmaleic anhydride) was replaced with the anhydrides indicated below, according to the following formulation:

| Ingredient | Amount (grams) |
|---|---|
| acetone | 60 |
| methanol | 40 |
| t-butyl α-naphthyl ether | 3.6 |
| 2,4-dimethoxybenzenediazonium hexafluorophosphate | 5.1 |

-continued

| Ingredient | Amount (grams) |
|---|---|
| anhydride | (A + B) |

in the amount given below to yield the tabulated density in the reexposed area as opposed to a density of 1.81 for the control film containing no anhydride.

| | | Grams | Density on re-exposure |
|---|---|---|---|
| (A) | trimellitic anhydride | 1.58 | 0.51 |
| (B) | 1,2,4,5-benzenetetracarboxylic anhydride | 1.8 | 0.52 |

EXAMPLE V

| Ingredient | Amount (grams) |
|---|---|
| ethanol | 11.0 |
| acetone | 22.0 |
| methanol | 17.0 |
| t-butyl α-naphthyl ether | 1.82 |
| 2,4-dimethoxybenzenediazonium hexafluorophosphate | 2.8 |
| alcohol soluble cellulose acetate butyrate | 2.0 |

The cellulose acetate butyrate was first stirred with the solvents until dissolved, then the ether and the diazonium salt were added and agitation was continued until the solution was complete.

The resultant composition was bead coated onto previously bond coated polyethylene terephthalate.

When the coated material was exposed, heated and ammoniated in the usual manner, a maximum density of 3.12 was read and the background areas had a density of 0.62.

Similar elements can be produced by replacing the cellulose acetate butyrate with cellulose acetate proprionate or a number of acrylic resins. This type of coating may also be applied with a Mayer rod or Bird Applicator.

Thus, it will be seen that the subject, uniquely novel negative-working diazography material is eminently well suited for such graphic arts applications as contact speed dye image films, for example, intermediate photographic masters for exposing the photoresist in printed circuits, high or low contrast films, films for aerial film duplication, or sign reversal, drawing restorations, films for the duplication of silver masters, and the like. And while the heretofore "conventional" negative-working systems, e.g. diazosulfonate [which system requires inordinately lengthy times for clearing, and which must immediately be developed to avoid diazo reversion], diazo-oxide [wherein the coupler is generated in situ, but which only derives from the diazo and therefore necessitates more of a diazo "loading"; moreover, there is a marked problem in realizing high densities with this film, attenuation is not uncommon, and same is quite limited as regards the shades attainable], wet silver, dry silver, free radical dye image film, Dylux dye film, etc., are each characterized by deficiencies such as complexity of processing, excessive thermal requirements for developing, poor image stability, poor resolution, excessive clearing energy requirements, and the like, the diazotype material according to the invention (1) is processable with a comparatively weak, moist ammonia atmosphere, compatible with positive-working dye image components, which processing is additionally simplified due to the wide latitude permitted in temperature and dwell, (2) eliminates any need for a clearing or fixing step, (3) does not exude toxic vapors in exposure or processing, (4) enables photographic speeds greater than existing diazo films, (5) achieves the resolution potential of 500 to 1000 lines/mm that is inherent in diazo materials when run in continuous roll processing machines [due to a lower exposure requirement and a significant reduction in nitrogen gas released from the film during exposure], (6) permits obtaining visual diffuse densities of up to 2.5 while maintaining a gamma of between 1.3 and 1.8 [the shape of the sensitometric curve is ideal for photointerpretation], (7) can be adapted for daylight handling, (8) displays fixed sensitometry, i.e., sensitometry remains unchanged, despite reasonable variations in processor temperature, vapor concentration or dwell, (9) is adapted for essentially dry processing, no liquid chemical disposal problem or drying of film required after processing, (10) is characterized by practical in-line printing and processing [due to fixed sensitometry, variations and exposure speed in a continuous machine will not affect sensitometry], (11) requires but inexpensive processing chemicals, (12) requires no reclamation of silver [disposal of duplicates made on diazo is simple, since no silver has to be extracted; additionally, no recovery unit for the processor is required], and (13) requires minimal operator skills.

In capsule summary, the subject diazography materials are characterized by high resolution, high density, dry processing, dimensional stability and good shelf-life.

It will also be appreciated that the diazography material according to the invention too can be utilized in positive-working mode, i.e., rather than briefly imagewise exposing to light, for example, for from 8 to 20 seconds, preferably 8 to 12 seconds, whereby only that amount of acid is liberated strictly required for the catalytic unblocking and only minimal amounts of light-sensitive diazo are decomposed, the film can be exposed for much longer periods of time, whereby virtually all of the light-sensitive diazo is decomposed in the light-struck areas, and subsequent development by overall chart exposure followed by heating and ammoniation afford a positive image.

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims.

What is claimed is:

1. A negative-working, light-sensitive diazography formulation comprising (i) at least one diazonium compound D capable of forming an organic azo dyestuff D—YOH or D—Y'OH, (ii) at least one acid labile blocked-coupler adapted to be converted in the presence of acid into an active azo-coupling species YOH or Y'OH, said blocked-coupler being chemically inert with respect to said diazonium compound D and having the structural formula Y—O—B, wherein Y—O— is the residue of said active azo-coupling species YOH and further wherein the residue —O—B is an acid labile oxygen bridged blocking moiety B defining a radical selected from the group consisting of tertiary ether, acetal, ketal and MEM ether, (iii) at least one light-sensitive acid progenitor adapted to photolytically generate an acid species capable of unblocking said blocked-coupler Y—O—B to convert same into said active azo-coupling component YOH, or rearrangement derivative Y'OH thereof, and (iv) at least one carboxylic acid anhydride adapted to inactivate, when subjected to alkaline developing conditions, unreacted diazonium compound remaining in the unexposed portions of the formulation after imagewise exposure to light.

2. A negative-working, light-sensitive diazography formulation comprising (i) at least one light-sensitive salt of a diazonium compound D capable of forming an organic azo dyestuff D—YOH or D—Y'OH, said salt being adapted to photolytically generate an acid species capable of unblocking the below blocked-coupler Y—O—B (ii) to convert same into an active azo-coupling component YOH or Y'OH, (ii) at least one acid labile blocked-coupler adapted to be converted in the presence of said acid species into said active azo-coupling component YOH or rearrangement derivative Y'OH thereof, said blocked-coupler being chemically inert with respect to said salt of said diazonium compound D and having the structural formula Y—O—B, wherein Y—O— is the residue of said active azo-coupling species YOH and further wherein the residue —O—B is an acid labile oxygen bridged blocking moiety B defining a radical selected from the group consisting of tertiary ether, acetal, ketal and MEM ether, and (iii) at least one carboxylic acid anhydride adapted to inactivate, when subjected to alkaline developing conditions, unreacted diazonium compound remaining in the unexposed portions of the formulation after imagewise exposure to light.

3. The diazography formulation as defined by claim 2 wherein said salt (i) is a diazo salt comprising a complex anion of a Lewis acid.

4. The diazography formulation as defined by claim 1 or 2 wherein said acid labile blocked-coupler has the structural formula:

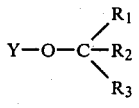

wherein each R, which may be the same or different, is selected from the group consisting of alkyl, alkenyl, alkynyl, aryl, cycloalkyl, cycloalkenyl, aralkyl, alkaryl, aralkenyl, and alkenylaryl, and Y is aryl.

5. The diazography formulation as defined by claim 4 wherein each R is selected from the group consisting of alkyl and aryl.

6. The diazography formulation as defined by claim 1 or 2 wherein said acid labile blocked-coupler has the structural formula:

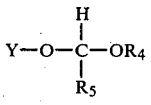

wherein $R_4$ and $R_5$, which may be the same or different, are selected from the group consisting of alkyl, alkenyl, alkynyl, aryl, cycloalkyl, cycloalkenyl, aralkyl, alkaryl, aralkenyl and alkenylaryl, $R_5$ may also be hydrogen, and Y is aryl.

7. The diazography formulation as defined by claim 6 wherein $R_4$ and $R_5$ are selected from the group consisting of alkyl and aryl.

8. The diazography formulation as defined by claim 1 or 2 wherein said acid labile blocked-coupler has the structural formula:

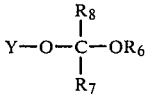

wherein $R_6$, $R_7$ and $R_8$, which may be the same or different, are selected from the group consisting of alkyl, alkenyl, alkynyl, aryl, cycloalkyl, cycloalkenyl, aralkyl, alkaryl, aralkenyl and alkenylaryl, and Y is aryl.

9. The diazography formulation as defined by claim 8 wherein $R_6$, $R_7$ and $R_8$ are selected from the group consisting of alkyl and aryl.

10. The diazography formulation as defined by claim 1 or 2 wherein said acid labile blocked-coupler has the structural formula:

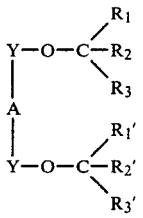

wherein each $R_1$, $R_2$ and $R_3$, which may be the same or different, is selected from the group consisting of alkyl, alkenyl, alkynyl, aryl, cycloalkyl, cycloalkenyl, aralkyl, alkaryl, aralkenyl and alkenylaryl, Y is aryl, and A is any bridging linkage.

11. The diazography formulation as defined by claim 10 wherein each $R_1$, $R_2$ and $R_3$ is selected from the group consisting of alkyl and aryl.

12. The diazography formulation as defined by claim 1 or 2 wherein said acid labile blocked-coupler has the structural formula:

wherein Y is aryl.

13. The diazography formulation as defined by claim 1 or 2 wherein said acid labile blocked-coupler has the structural formula:

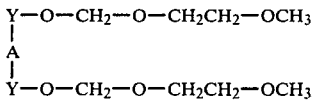

wherein Y is aryl and A is any bridging linkage.

14. The diazography formulation as defined by claim 1 or 2 wherein said acid labile blocked-coupler is selected from the group consisting of 1-naphthyl triphenylmethyl ether; 1-methylcyclopentyl 1-naphthyl ether; 1-butoxy-1-(1-naphthoxy)ethane; t-butyl phenyl ether; 2-(1-naphthoxy)-2-methylbutane; 1-(1-butoxy)-1-(1-naphthoxy)ethane; 1,2-bis(5-t-butoxy-1-naphthyl)ethane; dibenzo(d,f)-2,2-dimethyl-1,3-dioxepine; dibenzo(d,f)-2-methyl-2-phenyl-1,3-dioxepine; dibenzo(d,f)-

2,2-diphenyl-1,3-dioxepine; 2,2'-di(2-tetrahydropyranoxy)diphenyl; 2,3-isopropylidenedioxynaphthalene, t-butyl 1-naphthyl ether; 1-naphthyl 2-tetrahydropyranyl ether; benzo(e)-2-phenyl-1,3-dioxin; 1-t-butoxy-5-benzylnaphthalene; t-butyl (4-bromo-1-naphthyl) ether; dibenzo(d,f)-2-methyl-1,3-dioxepine; and $\beta$-methoxyethoxymethyl $\alpha$-naphthyl ether.

15. The diazography formulation as defined by claim 1 or 2 wherein said acid labile blocked-coupler is t-butyl 1-naphthyl ether.

16. The diazography formulation as defined by claim 2 wherein said light-sensitive salt comprises an anion selected from the group consisting of tetrafluoroborate, hexafluorophosphate, hexafluoroarsenate, hexafluoroantimonate, pentachlorobismuthate, stannous chloride and chlorozincate.

17. The diazography formulation as defined by claim 16 wherein said anion is hexafluorophosphate.

18. The diazography formulation as defined by claim 1 or 2 wherein said carboxylic acid anhydride is selected from the group consisting of substituted and unsubstituted maleic, succinic, glutaric, isatoic, naphthoic, phthalic, mellitic, acetic, glycolic, benzoic and butyric anhydrides.

19. The diazography formulation as defined by claim 1 or 2 wherein said carboxylic acid anhydride is selected from the group consisting of substituted and unsubstituted maleic anhydrides.

20. The diazography formulation as defined by claim 1 or 2 wherein said carboxylic acid anhydride is 2,3-dimethylmaleic anhydride.

21. The diazography formulation as defined by claim 1 or 2 wherein said carboxylic acid anhydride is trimellitic anhydride, 1,2,4,5-benzenetetracarboxylic anhydride, or a mixture thereof.

22. The diazography formulation as defined by claim 14 wherein said carboxylic acid anhydride is selected from the group consisting of substituted and unsubstituted maleic, succinic, glutaric, isatoic, naphthoic, phthalic, mellitic, acetic, glycolic, benzoic and butyric anhydrides.

23. The diazography formulation as defined by claim 14 wherein said carboxylic acid anhydride is 2,3-dimethylmaleic anhydride, trimellitic anhydride, 1,2,4,5-benzenetetracarboxylic anhydride, or a mixture thereof.

24. The diazography formulation as defined by claim 2 wherein said acid labile blocked-coupler is t-butyl 1-naphthyl ether, said light-sensitive salt comprises an anion selected from the group consisting of tetrafluoroborate, hexafluorophosphate, hexafluoroarsenate, hexafluoroantimonate pentachlorobismuthate, stannous chloride and chlorozincate, and said carboxylic acid anhydride is selected from the group consisting of substituted and unsubstituted maleic, succinic, glutaric, isatoic, naphthoic, phthalic, mellitic, acetic, glycolic, benzoic and butyric anhydrides.

25. The diazography formulation as defined by claim 24 wherein said anion is hexafluorophosphate and said carboxylic acid anhydride is 2,3-dimethylmaleic anhydride, trimellitic anhydride, 1,2,4,5-benzenetetracarboxylic anhydride, or a mixture thereof.

26. A light-sensitive diazotype photoreproduction material comprising a support member coated with the diazography formulation as defined by claim 1, 2, 3, 16, 17, 24 or 25.

27. A light-sensitive diazophotoreproduction material comprising a support member coated with the diazography formulation as defined by claim 14.

28. A light-sensitive diazophotoreproduction material comprising a support member coated with the diazography formulation as defined by claim 18.

29. The photoreproduction material as defined by claim 26, said support member being a film substrate.

30. The photoreproduction material as defined by claim 29, said diazography formulation including a resin matrix.

31. A negative-working diazography photoreproduction process comprising imagewise exposing the diazotype material as defined by claim 26 to light of a quality and quantity sufficient to photochemically liberate catalytic amounts of acid therefrom, thus unblocking coupler molecules, and thence developing said diazotype material under alkaline conditions such that active azo-coupling species couple with undecomposed diazonium compound in the light-struck areas to form azo dye while unreacted diazonium compound remaining in the areas not exposed to light is inactivated.

32. A negative-working diazography photoreproduction process comprising imagewise exposing the diazotype material as defined by claim 26 to light of a quality and quantity sufficient to photochemically liberate catalytic amounts of acid therefrom, thus unblocking coupler molecules, heating the thus-exposed diazotype material, and thence developing said diazotype material under alkaline conditions such that active azo-coupling species couple with undecomposed diazonium compound in the light-struck areas to form azo dye while unreacted diazonium compound remaining in the areas not exposed to light is inactivated.

33. The process as defined by claim 32 wherein the diazotype material is heated during development.

34. The diazography formulation as defined by claim 1 or 2, said acid labile blocked-coupler having the structural formula:

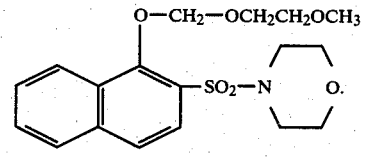

35. The diazography formulation as defined by claim 1 or 2, said acid labile blocked-coupler having the structural formula:

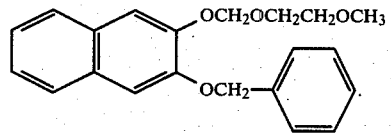

36. The diazography formulation as defined by claim 1 or 2, said acid labile blocked-coupler having the structural formula:

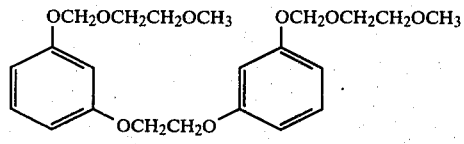

37. The diazography formulation as defined by claim 1 or 2, said acid labile blocked-coupler having the structural formula:

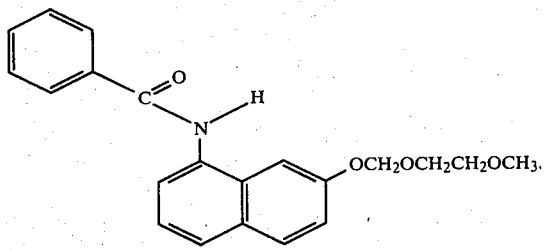

38. The diazography formulation as defined by claim 1 or 2, said acid labile blocked-coupler having the structural formula:

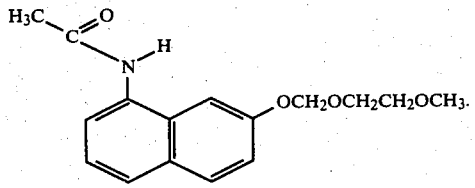

39. The diazography formulation as defined by claim 1 or 2, said acid labile blocked-coupler having the structural formula:

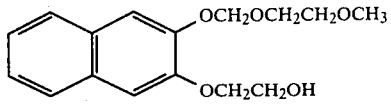

40. The diazography formulation as defined by claim 1 or 2, the diazonium compound/salt including a cation selected from the group consisting of p-chlorobenzenediazonium; 2,4-dichlorobenzenediazonium; 2,5-dichlorobenzenediazonium; 2,4,6-trichlorobenzenediazonium; p-methoxybenzenediazonium; o-methoxybenzenediazonium; 2-chloro-4-(dimethylamino)-5-methoxybenzenediazonium; 4-chloro-2,5-dimethoxybenzenediazonium; 2,4,5-triethoxy-4-biphenyldiazonium-[2,5-diethoxy-4-(p-ethoxyphenyl)-benzenediazonium]; 2,5-dimethoxy-4'-methyl-4-biphenyldiazonium[2,5-dimethoxy-4-(p-tolyl)benzenediazonium]; 2,5-diethoxy-4-(phenylthio)benzenediazonium; 2,5-diethoxy-4-(p-tolylthio)qbenzenediazonium; p-morpholinobenzenediazonium; 2,5-dichloro-4-morpholinobenzenediazonium; 2,5-dimethoxy-4-morpholinobenzenediazonium; and 4-(dimethylamino)naphthalenediazonium.

* * * * *